US009484137B2

(12) United States Patent
Kocijan

(10) Patent No.: US 9,484,137 B2
(45) Date of Patent: Nov. 1, 2016

(54) MAGNET ARRAYS

(71) Applicant: MAGSWITCH TECHNOLOGY WORLDWIDE PTY LTD, Rawdon Island (AU)

(72) Inventor: Franz Kocijan, Pappinbarra (AU)

(73) Assignee: MAGSWITCH TECHNOLOGY WORLDWIDE PTY LTD, Rawdon Island (AU)

( * ) Notice: Subject to any disclaimer, the term of this patent is extended or adjusted under 35 U.S.C. 154(b) by 0 days.

(21) Appl. No.: 14/508,371

(22) Filed: Oct. 7, 2014

(65) Prior Publication Data

US 2015/0042427 A1 Feb. 12, 2015

Related U.S. Application Data

(63) Continuation of application No. 13/793,548, filed on Mar. 11, 2013, now Pat. No. 8,878,639, which is a continuation of application No. 13/278,340, filed on Oct. 21, 2011, now abandoned, which is a continuation of application No. 12/088,071, filed as application No. PCT/AU2006/001407 on Sep. 26, 2006, now abandoned.

(30) Foreign Application Priority Data

Sep. 26, 2005 (AU) ..... 2005905298

(51) Int. Cl.
*H01F 7/20* (2006.01)
*H01F 7/02* (2006.01)
(Continued)

(52) U.S. Cl.
CPC ..... *H01F 7/0273* (2013.01); *B25B 11/002* (2013.01); *B66C 1/04* (2013.01); *H01F 7/02* (2013.01); *H01F 7/0252* (2013.01); *H01F 7/0257* (2013.01); *H01F 7/04* (2013.01)

(58) Field of Classification Search
USPC ..... 335/285, 287, 289, 306
See application file for complete search history.

(56) References Cited

U.S. PATENT DOCUMENTS 687,931 A * 12/1901 Barr ..... 335/289
2,209,558 A * 7/1940 Bing et al. ..... 335/295

(Continued)

FOREIGN PATENT DOCUMENTS

AU 753496 10/2002
CN 1246169 3/2000

(Continued)

OTHER PUBLICATIONS

"Magswitch Manual Heavy Lifters Operation and Instruction Manual," Magswitch Technology Inc., 2012, 9 pages.

(Continued)

*Primary Examiner* — Alexander Talpalatski
(74) *Attorney, Agent, or Firm* — Faegre Baker Daniels LLP

(57) ABSTRACT

Method and device for self-regulated flux transfer from a source of magnetic energy into one or more ferromagnetic work pieces, wherein a plurality of magnets, each having at least one N-S pole pair defining a magnetization axis, are disposed in a medium having a first relative permeability, the magnets being arranged in an array in which gaps of predetermined distance are maintained between neighboring magnets in the array and in which the magnetization axes of the magnets are oriented such that immediately neighboring magnets face one another with opposite polarities, such arrangement representing a magnetic tank circuit in which internal flux paths through the medium exist between neighboring magnets and magnetic flux access portals are defined between oppositely polarized pole pieces of such neighboring magnets, and wherein at least one working circuit is created which has a reluctance that is lower than that of the magnetic tank circuit by bringing one or more of the magnetic flux access portals into close vicinity to or contact with a surface of a ferromagnetic body having a second relative permeability that is higher than the first relative permeability, whereby a limit of effective flux transfer from the magnetic tank circuit into the working circuit will be reached when the work piece approaches magnetic saturation and the reluctance of the work circuit substantially equals the reluctance of the tank circuit.

4 Claims, 8 Drawing Sheets

(51) Int. Cl.

| | |
|---|---|
| ***B25B 11/00*** | (2006.01) |
| ***B66C 1/04*** | (2006.01) |
| ***H01F 7/04*** | (2006.01) |

(56) References Cited

U.S. PATENT DOCUMENTS

| | | | | |
|---|---|---|---|---|
| 2,287,286 | A | 6/1942 | Bing et al. | |
| 2,479,584 | A * | 8/1949 | Meyer | 279/128 |
| 2,596,322 | A | 5/1952 | Zumwalt | |
| 2,694,164 | A | 11/1954 | Geppelt | |
| 2,838,009 | A | 6/1958 | Bonanno | |
| 2,972,485 | A * | 2/1961 | Ferchland | 335/295 |
| 3,121,193 | A | 2/1964 | Engelsted et al. | |
| 3,223,898 | A * | 12/1965 | Bey | 335/295 |
| 3,298,730 | A | 1/1967 | Soley | |
| 3,389,356 | A | 6/1968 | Schneider | |
| 3,452,310 | A | 6/1969 | Israelson | |
| 3,471,193 | A | 10/1969 | Hayes | |
| 3,690,393 | A | 9/1972 | Guy | |
| 3,810,515 | A | 5/1974 | Ingro | |
| 3,812,629 | A * | 5/1974 | Campbell | 451/364 |
| 3,928,730 | A | 12/1975 | Aagaard et al. | |
| 4,055,824 | A * | 10/1977 | Baermann | 335/288 |
| 4,314,219 | A * | 2/1982 | Haraguchi | 335/295 |
| 4,468,648 | A | 8/1984 | Uchikune | |
| 4,482,034 | A | 11/1984 | Baermann | |
| 4,504,088 | A | 3/1985 | Carter | |
| 4,507,635 | A * | 3/1985 | Cardone et al. | 335/291 |
| 4,542,890 | A * | 9/1985 | Braillon | 269/8 |
| 4,616,796 | A * | 10/1986 | Inoue | 248/206.5 |
| 4,802,702 | A | 2/1989 | Bownds | |
| 4,956,625 | A * | 9/1990 | Cardone et al. | 335/290 |
| 5,220,869 | A | 6/1993 | Pelrine et al. | |
| 5,266,914 | A * | 11/1993 | Dickson et al. | 335/288 |
| 5,382,935 | A * | 1/1995 | Doyelle | 335/288 |
| 5,435,613 | A * | 7/1995 | Jung | 294/65.5 |
| 5,631,618 | A | 5/1997 | Trumper et al. | |
| 5,809,099 | A | 9/1998 | Kim et al. | |
| 5,853,655 | A | 12/1998 | Baker | |
| 6,076,873 | A * | 6/2000 | Jung | 294/65.5 |
| 6,094,119 | A | 7/2000 | Reznik et al. | |
| 6,104,271 | A | 8/2000 | Barrett | |
| 6,489,871 | B1 * | 12/2002 | Barton | 335/285 |
| 6,654,156 | B1 | 11/2003 | Crossland et al. | |
| 6,707,360 | B2 * | 3/2004 | Underwood et al. | 335/288 |
| 6,886,651 | B1 | 5/2005 | Slocum et al. | |
| 7,012,495 | B2 | 3/2006 | Underwood | |
| 7,161,451 | B2 | 1/2007 | Shen | |
| 2002/0105400 | A1 * | 8/2002 | Underwood et al. | 335/205 |
| 2003/0146633 | A1 | 8/2003 | Jung | |
| 2004/0239460 | A1 * | 12/2004 | Kocijan | 335/207 |
| 2005/0269827 | A1 | 12/2005 | Heard | |
| 2009/0027149 | A1 | 1/2009 | Kocijan | |
| 2009/0078484 | A1 | 3/2009 | Kocijan | |
| 2012/0092104 | A1 | 4/2012 | Kocijan | |
| 2012/0200380 | A1 | 8/2012 | Kocijan | |
| 2013/0320686 | A1 | 12/2013 | Morton | |

FOREIGN PATENT DOCUMENTS

| | | |
|---|---|---|
| CN | 1453161 | 11/2003 |
| DE | 1121242 | 1/1962 |
| EP | 0444009 | 8/1991 |
| EP | 0974545 | 11/2003 |
| JP | S55-151775 | 11/1980 |
| JP | 2000-318861 | 11/2000 |
| JP | 3816136 | 8/2006 |
| JP | 4743966 | 8/2011 |
| RU | 2055748 | 3/1996 |
| WO | WO 00/40018 | 7/2000 |
| WO | WO 2005/005049 | 1/2005 |

OTHER PUBLICATIONS

European Search Report for European Patent Application No. 06790278, mailed May 17, 2011, 2 pages.

International Preliminary Report on Patentability for International Patent Application No. PCT/AU2007/000277, mailed Nov. 22, 2007.

International Preliminary Report on Patentability prepared by the Australian Patent Office for International Application No. PCT/AU2006/001407, filed Sep. 26, 2006.

International Searach Report for International Patent Application No. PCT/AU2007/000277, mailed May 17, 2007.

International Search Report dated Dec. 18, 2006, prepared by the Australian Patent Office for International Application No. PCT/AU2006/001407 filed Sep. 26, 2006.

International Search Report for PCT Patent Application No. PCT/IB2013/001102, mailed Aug. 15, 2013, 4 pages.

Notice of Allowance for U.S. Appl. No. 13/444,757 mailed Aug. 5, 2013, 6 pages.

Official Action for U.S. Appl. No. 13/444,757, mailed Jan. 17, 2013, 7 pages.

Official Action for U.S. Appl. No. 12/088,071, mailed Apr. 21, 2011, 14 pages.

Official Action for U.S. Appl. No. 12/088,071, mailed Aug. 31, 2010, 11 pages.

Official Action for U.S. Appl. No. 12/282,830, mailed Oct. 12, 2011, 2011, 8 pages.

Official Action for U.S. Appl. No. 13/278,340, mailed Apr. 11, 2012, 22 pages.

Official Action for U.S. Appl. No. 13/278,340, mailed Sep. 11, 2012, 19 pages.

Official Action for U.S. Appl. No. 13/444,757, mailed Aug. 28, 2012, 6 pages.

Written Opinion for International Patent Application No. PCT/AU2006/001407, mailed Jan. 5, 2007.

Written Opinion for International Patent Application No. PCT/AU2007/000277, mailed May 17, 2007.

* cited by examiner

MAGNET ARRAYS

This application is a continuation of U.S. patent application Ser. No. 13/793,548, filed Mar. 11, 2013; which is a continuation of U.S. patent application Ser. No. 13/278,340, filed Oct. 21, 2011; which is a continuation of U.S. patent application Ser. No. 12/088,071, filed Mar. 25, 2008; which is a national stage application under 35 U.S.C. 371 of PCT Application No. PCT/AU2006/001407 having an international filing date of Sep. 26, 2006, which designated the United States and claimed the benefit of Australian Application No. 2005905298, filed Sep. 26, 2005. The entire disclosure of each is hereby incorporated by reference herein.

TECHNICAL FIELD

The present invention relates to magnet arrays which can provide a desired magnet field pattern thereby to enable optimised utilization of the magnetic energy contained in the magnets, such as when interacting with a work piece with limited ferromagnetic properties, caused for example by insufficient thickness of the material or its material type.

BACKGROUND TO THE INVENTION AND PRIOR ART

The present invention was conceived initially in the context of magnetic lifting devices, but as will become evident from the below description, it has applications beyond devices for hoisting ferromagnetic materials and work piece holders. Development of the invention was effected in the context of permanent magnets but it is believed that the underlying principles are transferable to magnet arrays that employ electromagnets.

Magnetic lifters are versatile material handling devices that use magnetic force to attach one or more ferrous material work pieces, ranging from small bundles of rod or scrap material to large heavy blocks or sheets of ferromagnetic materials, to a contact face of the device, thereby allowing transport of the work piece from one location to another whilst being securely held by the device.

Magnetic lifters can either utilize electro-magnets, which allow for adjustment of the magnetic field and thus the pulling force exerted onto a work piece at the contact face of the lifter device, or employ permanent magnets which are held in a movable rotor (or other support structure) within a housing so as to be selectively brought into interaction with passive pole pieces that abut at (or provide) the work piece contact face of the device, ie the contact face may be devised to act as a passive pole piece for the magnet(s) such that direct contact between magnet(s) body and work piece is avoided to prevent environmental contamination of the magnet(s) or operational difficulty in separation of the work piece from the magnets.

Modern permanent magnet lifters, in general, utilize permanent magnets which generally produce a high intensity magnetic field. Advances in metallurgy and magnetic technology in the last decades have resulted in the availability of magnetic materials with unprecedented power—most notably "Rare Earth" magnets, some of which exhibit a pulling strength of more than 100 times their own weight. They do not suffer significantly from problems like degrading over time or sudden loss of magnetic power due to exposure to moderate external magnetic influences or the removal of keepers, as 'traditional' permanent magnets tend to suffer.

Permanent magnet lifters having low dead weight and lifting capacities from 100 to 2000 Kg have thus been introduced into the market place.

Examples of permanent magnet lifting devices which allow manual activation and deactivation of the lifter are those manufactured and sold by the Italian company Tecnomagnete under their RD modules, SMH module, and MaxX and MaxX TG Series.

A turn-off permanent magnet for use as a lifter is disclosed in U.S. Pat. No. 3,452,310 (Israelson). There, a stack of ceramic plate magnets (providing a first N-S dipole structure) is held sandwiched at an upper end of and between rectangular, plate-like pole pieces which provide at their lower free ends the working air gap for attachment to a ferromagnetic work piece. An armature consisting of a stack of ceramic plate magnets (providing a second N-S dipole structure) with segment-shaped pole pieces at each stack end is held rotatably within a cylindrical zone defined between and extending into the plate-like pole pieces, whereby the rotational position of the armature will either augment the magnetic field at the pole piece working faces (i.e. the N and S poles of the armature coincide with the N and S poles which the first dipole structure imparts to the pole pieces) or effectively shunt the magnetic field of the upper magnet stack by providing an internal closed loop magnetic path between the dipole structures.

U.S. Pat. No. 4,314,219 (Haraguchi) describes a somewhat similar concept, wherein a plurality of rotatable armatures consisting of stacked plate-like permanent magnets are disposed in an array within cylindrical cavities defined between a plurality of (magnetisable) passive magnetic poles encased within an outer non-magnetiseable housing. Here again, rotational position of the armatures will dictate the magnetization state of the pole pieces which are used to provide an external flux path when the pole piece working faces abut on a work piece.

These types of lifters produce in their active state in general a fixed magnetising force which is directly related to the magnetic length of the particular design. Magnetic length is defined as the distance between pole pieces in between which is received a volume of active magnetic material, eg the length between opposite polarity end faces of a dipole magnet. The output of magnetic energy is dependent on the amount of active magnetic material and its type, thus essentially a fixed value. However, in situations where the work load cannot absorb all magnetic energy provided by the magnet, the pulling force on an attached object is reduced. The surplus magnetic energy presents itself as leakage with associated magnetic stray fields.

Whilst factors concerning load carrying capacity are mostly properly addressed in existing devices, problems remain.

A particular problem exists in magnetic lifter applications where it is necessary to lift single metal sheets from a stack of such sheets. Existing devices are primarily configured for weight lifting capacity and will have a contact surface that enables planar attachment to the upper most sheet in a stack. However, such lifters will be unable to lift in a discrete manner a single sheet from the stack unless an air gap of sufficient height between the upper most and the next sheet in the stack is maintained, or the relative position of the permanent magnets employed to 'switch' the device on and off is chosen to assume an 'intermediate' state where the magnetic flux density available at the pole piece faces that engage with the work piece is reduced, with a consequential drop in the magnetic pulling force. The same considerations apply to electromagnetic lifters when the electric current is reduced to allow for sheet separation and avoidance of magnetic field penetration into adjoining sheets.

In the case of permanent magnetic lifters, when the pole pieces, which are in contact with the permanent magnets, are brought with their working surfaces into contact with the upper most metal sheet, a closed or loaded magnetic circuit is created. Unless the (magnetic) permeability of the sheet material and thickness of the sheet are such that the (external) magnetic flux path created is fully confined within the upper sheet, and no leakage (le a flux path outside the intended magnetic circuit comprising the magnet(s), pole pieces and upper sheet alone) spills into the adjoining next sheet, the lifter device will tend to lift such number of sheets which are magnetically attached together, as determined by the maximum weight lifting capacity and penetration of the magnetic field of the magnet(s) into the stacked sheets. In other words, if the uppermost metal sheet can not carry the whole magnetic flux provided by the magnet(s), flux oversaturation will occur in the upper most sheet, and the magnetic field will extend beyond the thickness of the upper most sheet into the lower next sheet(s) to an extent where saturation of a lowermost located sheet is no longer present; the magnetizing force in effect will magnetically clamp a number of sheets together for lifting by the lifter device.

A typical approach to deal with the single sheet lifting problem is described in US patent application publication US 2005/0269827 A1. This document describes a permanent magnet lifting system which employs as Integral components on a frame a plurality of shallow-field magnetic devices specifically devised to allow lifting off single ferromagnetic sheets from a stack of sheets.

A plurality of magnetic lifting devices is arranged in a two-dimensional array, eg 4×2 rectangular array, to engage the sheet at multiple locations over the sheet's top surface area. Importantly, the individual lifting devices are spaced apart to such an extent that no interaction takes place between the respective magnetic fields and fluxes which each of the devices generate when in contact with a metal sheet.

To limit the penetration depth of the magnetic field of each magnetic device, permanent magnets with short and fixed magnetic length are used. In order to increase overall volume of active magnetic material and achieve the desired lifting capacity, a plurality of such individual short length magnets are connected in series to provide a single magnetic field orientation, ie each device is comprised of a stack of permanent magnet plates (magnetised in the thickness direction of the plate such that opposite faces have opposite polarities) interleaved with soft iron pole piece plates. The magnet plates are arranged alternately with faces of equal polarity opposing one another across the intervening pole piece, such that a series of alternating North-South-North-etc. magnetic fields along the stacking direction are present between pole pieces, neighbouring pole pieces thus providing a plurality of working (air) gaps along the stacking direction. That is, the active magnetic material of each device is subdivided into discrete portions and interleaved and in contact with passive magnetic material, thus creating a plurality of shallow magnetic field loops between the pole pieces.

One immediately apparent problem with the lifting frame of this US patent document is that the magnet devices can not be switched off, and mechanical levers are used to forcibly disengage the sheet from the frame when required. Because the stacked row of individual short magnetic length magnets generate an overall uniform large flux in a common direction in an attached work piece sheet, the latter will be prone to remanence problems (residual magnetisation in the detached work piece).

It is one object of the present invention to provide in one aspect thereof, a lifter device which utilizes permanent magnets as a source of a magnet field intended to interact with ferromagnetic sheet material, and which device can be switched between 'on' and 'off' states, the 'on' state enabling discrete lifting of individual sheets from sheets stacked without a substantial air gap between neighbouring sheets.

It is another object of the present invention to provide in another aspect thereof, a configuration/arrangement of discrete magnetic field sources which overall generates an effective attraction force between a device incorporating the arrangement and a work piece and which simultaneously enables substantial confining of magnetic flux lines generated by the arrangement in the work piece upon an external magnetic circuit being created therewith.

Yet another object of the invention is to provide in another aspect thereof, a configuration/arrangement of discrete magnetic field sources which generates an effective pulling force between a device incorporating the arrangement and a work piece in which the pulling force exerted on the work piece is larger than the pulling force which the sum of the individual magnetic field sources would have.

Yet another object of the Invention is to provide in another aspect thereof, a configuration/arrangement of discrete magnetic field sources in a magnetic circuit which generates an effective pulling force between a device incorporating the arrangement and a work piece and in which the magnetic flux transfer is not unilaterally dictated by the magnetic field sources but wherein an autonomous internal magnetic flux regulation takes place to match the magnetising force of the flux source to the ferromagnetic saturation properties of an external load provided by the work piece.

SUMMARY OF THE INVENTION

In a first aspect of the present invention there is provided a magnetic device for effecting magnetic flux transfer into a ferromagnetic body, having a plurality of magnets, each having at least one N-S pole pair defining a magnetization axis, the magnets being located in a medium having a first relative permeability in a predetermined array configuration with defined gap spacing between the magnets and with the magnetization axes extending in predetermined orientations and preferably in a common plane, the device having a face operatively disposed to be brought into proximity or abutment with a surface of a ferromagnetic body having a second relative permeability that is higher than the first relative permeability thereby to create a closed or loaded magnetic circuit between the magnets and the ferromagnetic body and effecting flux transfer through the ferromagnetic body between N and S poles of the magnets.

In another aspect of the present invention there is provided a method of self-regulated flux transfer from a source of magnetic energy into one or more ferromagnetic work pieces, wherein a plurality of magnets, each having at least one N-S pole pair defining a magnetization axis, are disposed in a medium having a first relative permeability, the magnets being arranged in an array in which a gap of predetermined distance is maintained between neighboring magnets in the array (and consequently the medium) and in which the magnetization axes of the magnets are oriented such that the magnets face one another with opposite polarities and preferably extend in a common plane, such arrangement representing a closed Magnetic Tank Circuit in which magnetic flux paths through the medium exist between neighboring magnets and magnetic flux access portals are defined between oppositely polarized pole pieces of such neighboring magnets, and wherein at least one work circuit is created which has a reluctance that is lower than that of the magnetic tank circuit by bringing one or more of the magnetic flux access portals into as close as possible vicinity to or contact with a surface of a ferromagnetic body having a second relative permeability that is higher than the first relative permeability, whereby a limit of effective flux transfer from the magnetic tank circuit into the work pieces will be reached when the work piece approaches magnetic saturation and the reluctance of the work circuit substantially equals the Internal reluctance of the tank circuit.

In such array, two kinds of flux portals exist—a first one is between the pole pieces of the individual magnets with a first (forward) flux direction and the second one is between the pole pieces of neighboring magnets in with a second (opposite) flux direction. Therefore no uniform flux direction exists in the array and less problems with remanence in work pieces will ensue (less residual magnetism after detachment of a work piece from such array).

This process allows an autonomous and demand regulated flux transfer between the Tank Circuit and the Work Circuit which will adjust very quickly, almost spontaneously, to the conditions of the Work Circuit. Over-saturation with significant leakage beyond the physical boundaries of the work piece is not possible. It will be appreciated that the above features defining self-regulating flux transfer can be incorporated into a magnetic coupling device as will become clearer herein after.

Whilst the above broad concepts and additional concepts described below can be embodied using different types of magnetic flux sources such as electromagnets, use of permanent magnets, and more particularly on-off switchable permanent magnet units are preferably used. In preferred embodiments of both of the above aspects of the invention, switchable magnet units such as those described in U.S. Pat. Nos. 6,707,360 and 7,012,495 and commercially available from Magswitch Technology Worldwide Pty Ltd, Australia, are used in the array. From here on in, different aspects of the invention will be explained by reference only to permanent magnets as a source of an N-S pole pair, i.e. an active magnetic material which provides the source of magnetic flux and magnetomotive force, noting that these can be substituted by the skilled person with other, suitably devised magnetic flux sources.

Equally, given that preferred embodiments of the invention seek to employ a plurality of switchable permanent magnets as described in U.S. Pat. Nos. 6,707,360 and 7,012,495, reference should be made to those documents for further details and understanding of switchable permanent magnetic devices, the documents being incorporated herein by way of short-hand cross-reference.

Given that each (permanent) magnet in the array will have at least one N-S pole pair, different interaction patterns of neighboring magnets in the array will be caused depending on the relative positioning of the pole pair magnetization axes within the overall array configuration, i.e. not only the spacing of the individual magnets from each other, but also the spatial orientation of the N-S pole pairs in each magnet relative to that of a neighboring magnet unit needs to be considered.

Consequently, depending on how the discrete magnets are spaced from one another and arranged into a given array configuration, not only will the Individual magnetic fields of the magnets possibly interact, but additional flux paths can be created not only between neighboring magnets, but also through additional flux loops in a ferromagnetic work piece attached to or in very close proximity of the magnet array. In one magnet array arrangement, in addition to the magnetic fields provided by the Individual N-S pole pairs, additional magnetic fields are provided between opposite poles of neighboring magnets.

The concept of arranging individual permanent magnets in an array wherein neighboring magnets are disposed with their magnetization axes in different orientations is in itself not new. Such arrangements have been devised with the aim of shifting magnetic flux into a specific pattern. A basic Halbach array, for example, may consist of five individual, permanent cube dipole magnets (eg Neodymium-Iron-Boron magnets) which are secured into a linear array with side faces abutting one another, the magnetization axes (ie N-S axis) of adjoining magnets being rotated clockwise, thereby creating a permanent magnet configuration (or device) that augments the magnetic field on one side of the device while canceling the field to near zero on the other side. Advantages of such one sided flux distributions can be seen in that, in the idealized case, the field is twice as large on one side on which the flux is confined whilst creating a flux free area elsewhere. Also known are dipole, quadrupole and multipole Halbach cylinders, consisting of a plurality of individual magnets having a regular trapezium cross-section and which are arranged into a closed ring. Equally, an array of individual electromagnets that is devised to mimic the linear Halbach array described above is known from U.S. Pat. No. 5,631,618.

It should be noted here that the objectives and functions of the present invention are not comparable with Halbach array type devices. The arrays in accordance with the invention require individual magnets, which themselves may be comprised of multiple magnet pieces arranged to provide preferably a dipole magnet unit (but not excluding also multi-pole magnets), to be spaced apart from one another and maintain a gap within the array, is it is essential that the individual magnets are kept at a selected distance from one another, the distance being such as to ensure the creation and presence of additional flux exchange zones between neighboring magnets. The flux will pass through the medium located between the magnet array constituents. The medium might be air, a plastic material or other substance having ideally a low relative permeability (air having a reference permeability value of approximately 1).

The inventive arrays are not intended to confine flux to one region of the magnetic device, rather allow harnessing an optimum amount of magnetic flux from all magnets for a given external circuit, as will become clearer from specific array embodiments described below.

In a preferred form, the magnet array will be located within a carrier (body) of the device, ie the array magnets will be secured within the carrier, which itself may provide a contact surface for interaction with the external circuit work piece.

Thus, in a more specific aspect, the present invention provides a magnetic device for effecting magnetic flux transfer into a ferromagnetic body, wherein the array consists of one or more linear rows of active dipole magnets, preferably of a switchable type described in U.S. Pat. No. 6,707,360 or U.S. Pat. No. 7,012,495, wherein the magnetization axes of the magnets are either about co-axial within a row or perpendicular to the row axis, and the neighboring magnets face one another with alternating polarities.

Such an arrangement is schematically illustrated in FIGS. 6, 7*a* and 7*b* of the accompanying drawings. Such alternating N-S pole arrangement effectively doubles the number of effective flux exchange areas and external flux paths of a closed magnetic circuit employing the array (ie when the magnetic device is brought in to contact with a ferromagnetic body, eg a steel sheet), but also without extending the field range. The effect of additional flux exchange areas is the increase of flux density at the contact areas of the passive pole pieces associated with each magnet, if that flux density is restricted by high reluctance of the steel sheet. Higher pulling forces and improved magnetic efficiency is achieved in this way. It should be noted that high reluctance is a function of the relative permeability and the cross-sectional area of a work piece such as a steel sheet.

In another more specific aspect, the present invention provides a magnetic device for effecting magnetic flux transfer into a ferromagnetic body, wherein the plurality of dipole magnets, preferably of a type described in the claims of AU Patent 753496 or U.S. Pat. No. 7,012,495, are arranged in one or more concentric circle array(s), and wherein the magnetization axis of each of the magnets extends either about perpendicular to a radius extending from the center of the circle to the respective magnet, or about coaxially with said respectively associated radius.

The first alternative of this array configuration will be referred to herein below as a Circular (or Ring) Array, wherein the magnetic axes of the magnets define tangents onto a common circle, whereas the second of the array alternatives will be termed a Star Array, given that the magnetization axes radiate star-like from the (common) center of the array. Of course, it will be appreciated that slight deviations from the precise geometric orientations described will only slightly affect overall performance of the device. Such Circular and Star Arrays are schematically illustrated in FIGS. 8*a* to 8*c* of the accompanying drawings.

It will also be appreciated that other array configurations can be embodied with a plurality of spaced apart magnet units, to suit a given application.

Closed magnet array configurations, in particular circular and oval array configurations have the advantage of avoiding unsymmetrical magnetic performance within the array and essentially provide for a confined magnetic field, given that there are no 'free' poles or array ends where magnetic flux may leak and not be transferred into the Intended useful external magnetic circuit.

Circular arrays are particularly well suited for use in Magnetic Tank Circuits, as defined above, given that the interaction between the individual magnet dipoles can be very intense because the adjacent poles of the individual magnets face each other directly. Planar pole piece faces and short gap spacing between neighboring magnets results in low internal reluctance of such a Tank Circuit.

Preferably, the spacing between the discrete magnets is fixed and equal, thereby to achieve symmetrical loading patterns within the array and when a closed external circuit is created with a work piece.

The magnetic device could, however, have a carrier which is devised to allow limited displacement of the discrete magnets with respect to one another such as to allow changing and re-fixing the distance of individual magnets within the array between a minimum and maximum value. The distance selected between the discrete magnets gives some control over the total field magnitude. Short distances between adjacent magnets will emphasise the flux exchange between the separate magnets with a decrease in total field intensity and overall field penetration depth into a work piece, eg a steel sheet. Wider spacing will give more weight to the flux exchange between the N and S poles of individual magnets, with an overall increase of field strength and relatively deeper flux penetration into work pieces.

The number and geometric size of the magnets, and the spacing layout within the array can be selected dependent on the Intended use of the magnetic device, eg in a metal sheet lifter, and the properties of the ferromagnetic body into which flux is to be transferred. By way of example, a circular array of 5 magnets of the type Magswitch Version M1008 in which a spacing of 1 mm is maintained between magnets can exert a pulling force of 145N on a 0.8 mm iron sheet. The pull on a second sheet in direct contact underneath is hardly noticeable in this case.

For Circular Array configurations, it is preferred that the polarities of adjoining magnets are opposite to one another, eg a N-S dipole is followed by another N-S dipole, etc. As has been noted above, and as is described in more detail below, such array configuration effectively creates a magnetic device with a self-regulating magnetic field strength (H) when the device is brought into contact with a ferromagnetic work piece, and exhibits multiple additional flux exchange areas provided between neighbouring magnets.

For Star Array configurations, it is possible to arrange the magnets such that their magnetizing axes all point with their N- or S-poles towards the center, which in effect means that the magnetic energy of the magnets is 'paralleled', enlarging the total magnetic energy available within the device, without creating additional flux exchange areas between neighbouring magnets, essentially mimicking a cup magnet with one inner magnetic pole (either S or N) and an outer pole (either N or S).

Alternatively, in a Star Configuration, it is possible to arrange the magnets in an alternating configuration wherein a N-S dipole is followed (adjacent) to a S-N dipole. In essence, such an array has multiple additional flux exchange areas provided between neighbouring magnets and forms a Magnetic Tank Circuit that exhibits a self-regulating magnetic field strength (H) which whilst not being as effective as that present in the above described Circular Array, represents a good overall middle ground between Tank Circuit properties and additional flux area numbers.

It should be pointed out that because Tank Circuit arrangements as described above are essentially self-regulating in so far as the magnetic field strength is concerned, and because such self-regulation essentially limits the magnetising force which such magnet array is able to exert to the physical confines of the work piece in proximity (or contact) with the device's external interface (eg working face), no significant magnetisation force (and field) will 'leak' beyond the work piece. This makes the incorporation (or embodiment) of such arrays in coupling devices, where electronics are near a backside of the work piece, of particular interest. Thus, a magnetic quick attachment/release device can be created for use in applications where magnetic field interferences are to be avoided, such as for mobile phone halters, GPS fastening units, and other applications where coupling of one device to another is desired.

In yet another aspect of the present invention, there is provided a method of controlling penetration of a magnetic field into a work piece adjoining a magnet, consisting of subdividing a predetermined mass of active magnetic material into discrete, spaced-apart, preferably switchable magnets, and arranging the plurality of magnets into a linear (open) or circular (closed) array in such manner that neighboring magnets are disposed with alternating polarity with respect to one another across the gap between such magnets.

In yet a further aspect, the present invention provides a switchable permanent magnet lifting or coupling device, having a housing with a coupling face that may be brought into engagement with a ferromagnetic sheet-like work piece, and a plurality of switchable permanent magnet coupling units mounted in the housing at the coupling face and devised to magnetically secure the work piece to the lifting device, each unit including two cylindrical or disk-like permanent magnets stacked along a stacking axis and which are polarized to have at least one N-S pole pair extending between opposing axial end faces of the magnets along the stacking axis (diametrically polarized magnets), at least two magnetic pole pieces arranged about the perimeter of both permanent magnets and having axial end faces spaced along the stacking axis, the magnets being held for relative movement to one another along said stacking axis within the pole pieces, and actuator means arranged for selective rotation of one of the permanent magnets to switch the unit between an activated state, in which the magnetic polarities of both magnets are aligned and oriented in the same direction along the stacking axis, magnetic flux from the magnets passes through the pole pieces and a strong external magnetic field is present, and a deactivated state, in which the magnetic fields of both magnets warp into each other and the magnetic flux of the magnets is shunted and confined within the pole pieces and magnets themselves such that a weak or no external magnetic field is present, the units being arranged in an array configuration wherein (a) one of the magnets of the stacked pair of magnets and/or the pole pieces of each unit is/are located with their axial end face close or at the contact face and (b) the individual units are disposed with gaps between one another and with their respective magnetic pairs such as to enable flux exchange between neighboring units in the activated state of the units whereby magnetic flux penetration patterns into the work piece of otherwise individually activated units are altered.

In accordance with this aspect of the invention, there is provided a lifting device wherein magnetic flux penetration depth of each and the combined units into a work piece at the contact face is reduced, whilst maintaining the magnetic force available for lifting, when compared to a similar device that utilizes one or two switchable permanent magnet units of similar overall active magnetic material mass.

The pole pieces of each switchable magnet unit are advantageously manufactured from a suitable passive, magnetisable material, exhibiting the lowest possible reluctance to allow maximum magnetic flux densities, in contrast to the material of an overall protective or strengthening device housing, which should be preferably made of essentially non-ferromagnetic materials, such as stainless steel grade 316 or aluminum. Saturation values of the passive ferromagnetic pole piece material higher than the flux densities of the chosen magnetic active material allow magnetic flux compression above the flux density of the permanent magnet material with resulting higher pulling and magnetizing forces. Suitable materials for the pole pieces are low magnetic remanence purified iron, soft iron and soft steel, in that order, although mild steel may be preferred given its higher mechanical strength.

As noted, any optional lifter device housing or carrier of the individual switchable magnet units, but in particular the housing component that provides a contact surface with the pole pieces, should be made from a material that is not ferromagnetic to a practical extent.

A lifting device which will allow a greater level of flexibility with regards to rated lifting capacity may incorporate a predetermined number of individual switchable magnet units as described above, in a given array configuration, wherein an actuator mechanism is provided that is arranged to operate on the individual units to activate and deactivate these either jointly and concurrently, or selectively and concurrently. It is also possible to provide an actuator mechanism devised to individually activate and deactivate each of the units separately. Mechanical linkage arm arrangements or pneumatic or hydraulic circuits may be incorporated into such actuator mechanism in known manner.

It will be understood that the choice in size, performance parameters and numbers of Individual switchable permanent magnet units, as well as the specific layout of the individual polar axes of the units will depend on the properties of the work piece with regards to its magnetic material properties, weight and thickness.

A number of embodiments illustrative of different aspects and, preferred and optional features of the present invention will be described below with reference to the accompanying figures.

BRIEF DESCRIPTION OF THE DRAWINGS

FIG. 7*a* is a schematic and highly simplified (side) view of a linear array of multiple, switchable permanent magnet units illustrating some of the aspects of the present invention, whereas

DETAILED DESCRIPTION OF EMBODIMENTS

Figure 1:
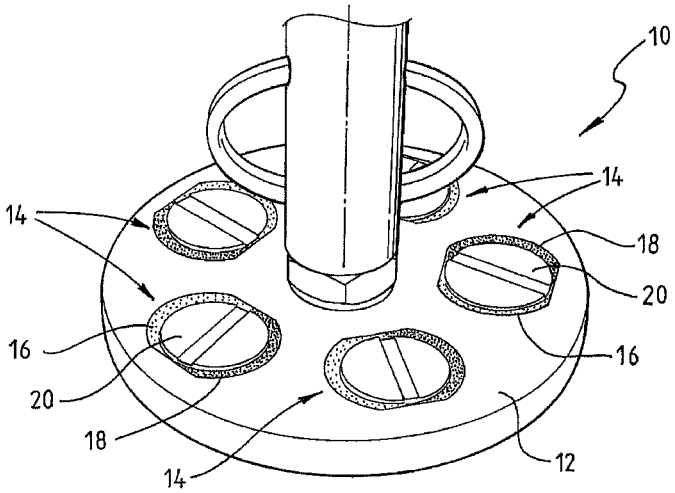
FIG. 1 is a perspective view of an experimental jig incorporating an array of Individual, switchable permanent magnet units, being used as a 'proof of concept' model embodying a number of aspects of the present invention.
Figure 2:
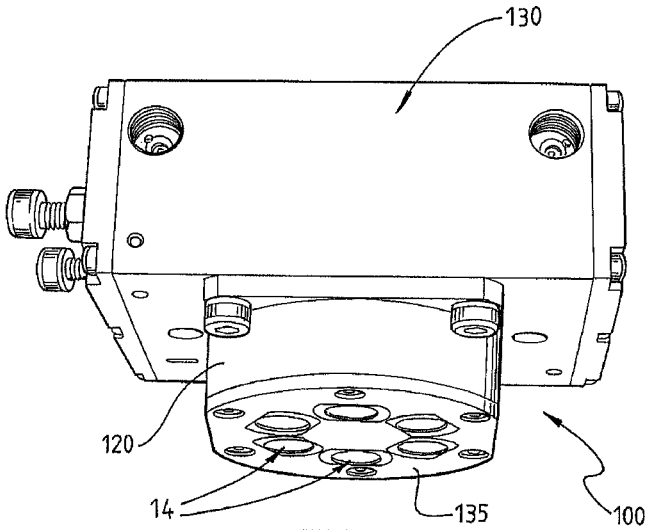
FIG. 2 is a perspective photographic view of a working model of a magnetic lifter device made in accordance with a number of aspects of the present invention.

FIG. 1 illustrates a test-rig-style switchable permanent magnet coupling device 10 incorporating one of the basic concepts underlying the present invention. Embodiments of such magnetic devices may be incorporated into more complex (or simple) apparatus and devices to releasably magnetically couple such device or apparatus to a ferromagnetic body, eg a magnetic lifter as illustrated in FIG. 2 adapted for lifting individual, thin, ferromagnetic sheet metal materials from a stack of such sheets.

Such device 10 includes a housing or carrier part 12 of substantially non-ferromagnetic material, in this case having a circular plate-like shape, in which are secured against movement five individual, permanent magnet coupling units 14, as will be described below. The units 14 are mounted in apertures that extend through part 12, and may be permanently secured, eg glued, or otherwise secured to allow exchange of Individual units. The units 14 are received at part 12 so that at least the non-visible bottom axial end faces of units 14 are either flush with the circular engagement surface of part 12 or protrude slightly therefrom. In FIG. 1, the magnets are flush with the upper face of the carrier part 12 and accessible to allow switching of each unit 14 between active and Inactive magnetisation positions. The units 14 are disposed in a circular array configuration about a central axis of device 10.

Figure 3A:
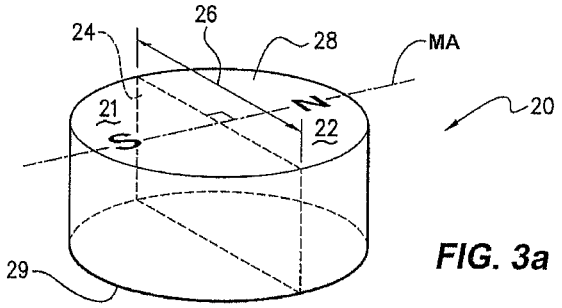
FIGS. 3*a* and 3*b* are perspective schematic illustrations of a single diametrically polarized permanent magnet and a switchable permanent magnet unit as may be employed in the devices of FIGS. 1 and 2.
Figure 3B:
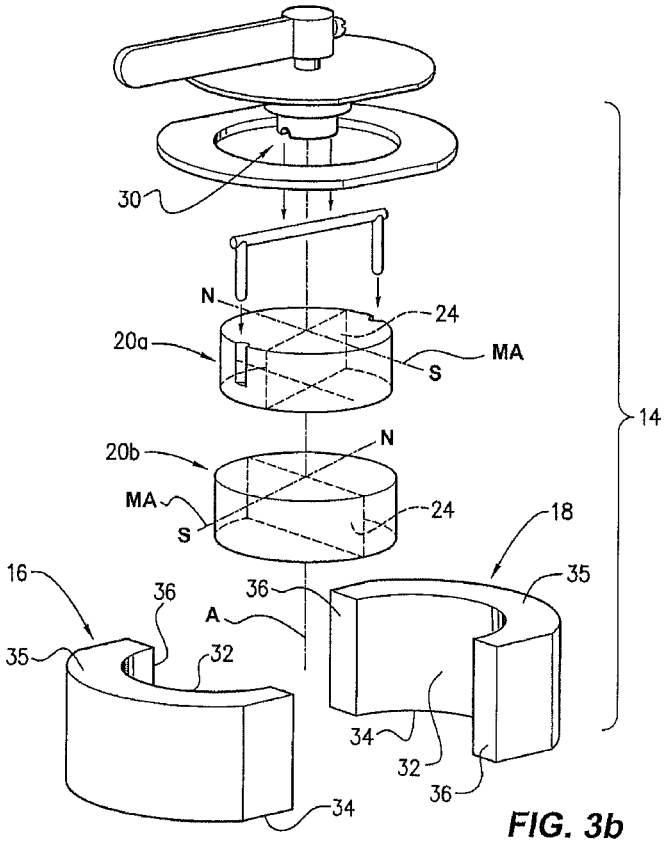

As will become clearer from the subsequent description of an individual unit 14 illustrated in FIG. 3*b*, each unit 14 includes a pair of stacked cylindrical permanent magnets 20 and two pole pieces 16 and 18 that surround the periphery of the magnets to substantially envelope same, wherein the lower (not illustrated) axial end faces of the pole pieces 16, 18, which are made of a soft iron material with high permeability, are either flush with or extend a small amount beyond the corresponding lower axial end face of the lower one of the cylindrical magnets 20.

One of the cylindrical magnets 20 of a unit 14 is shown in FIG. 3*a*. The magnet is diametrically magnetised across its entire axial length. By that is meant that the notional division between the North Pole (N) 22 and the South Pole (S) 21 of the magnet is provided by a vertical plane 24 that passes along a diameter 26 of the upper face 28 and the lower face 29 of magnet 20. The magnet 20 is still essentially a dipole having a magnetisation axis MA which is perpendicular to the vertical plane 24, wherein however the magnetic field strength along the circumference of the cylinder varies about in sinusoidal manner, wherein a minimum value exists at the N-S interface plane 24, and a maximum exists at about 90 degrees rotation along the circumference. Cylindrical (or disc-shaped) magnet 20 is preferably a rare-earth type magnet, for example a neodymium-iron-boron magnet, noting that currently available rare earth magnets will achieve a flux density maximum of around 1.4 Tesla, which is substantially below the saturation densities of good passive ferromagnetic materials that can be used for the pole pieces 16, 18. The present invention also contemplates the use of other active permanent magnetic materials.

Turning next to FIG. 3*b*, there is shown in disassembled state a switchable, permanent magnet unit 14 which but for the presence of a unit activation and deactivation mechanism 30 is in essence similar to the units 14 shown in FIG. 1.

Unit 14 includes two cylindrical magnets 20*a*, 20*b* of the type described above, of similar height dimensions and N-S poles make-up. An example is a 10 mm diameter×8 mm height cylindrical magnet. The lower magnet 20*b* is held in surface engaging contact between the two pole pieces 16 and 18, which are identical in shape and cross-section and have a magnet-facing internal surface 32 that is correspondingly curved to match the magnet's external peripheral surface, whereas the upper magnet 20*a* needs to maintain as minimum as possible gap towards the peripherally facing surfaces 32 of pole pieces 16 and 18 thereby to enable friction free (or minimised) rotation thereof within the pole pieces 16 and 18 and relative to the lower magnet 20*b* which is itself held immovable. Magnets 20*a* and 20*b* are simply stacked above one another along stacking axis A, which defines a longitudinal axis of unit 14, and such that upper magnet 20*a* may be rotated relative to lower magnet 20*b* using the actuating mechanism 30.

Further details as to the make-up, possible different configurations of the components of such magnet unit 14 and the principles of operation thereof are described in U.S. Pat. Nos. 6,707,360 and 7,012,495 to which reference should be made for further details.

For present purposes, it is sufficient to note that upper and lower magnets 20*a*, 20*b* are received in face to face juxtaposition within pole piece housing 16, 18, whereby rotation of the upper magnet 20*a* about axis of rotation A causes time-sequenced passage of the north pole region of upper magnet 20*a* over the pole regions N and S of lower magnet 20*b*. When in a position where the north pole of upper magnet 20*a* substantially aligns and coincides with the south pole of lower magnet, and consequently the south pole of upper magnet 20*a* substantially overlies the north pole of lower magnet 20*b*, the first and second magnets act as an internal, active magnetic shunt and as a result the external magnetic field strength from the unit would be ideally zero, assuming equal active magnetic mass in both magnets 20*a* and 20*b* and total flux carrying capacity of the pole pieces 16, 18 being higher than flux output of the combined magnets. Rotating the upper magnet 20*a* 180 degrees about axis of rotation A changes the alignment of the pole pairs of the magnets 20*a* and 20*b*, wherein the respective north and south poles of the upper magnet 20*a* substantially overlie respective north and south poles of lower magnet 20*b*. In this alignment, the external magnetic field from unit 14 device is quite strong and the device exerts a magnetic force onto a ferromagnetic work piece at the contact surfaces 34 of the unit 14 (provided by the bottom axial end faces of pole pieces 16, 18) thereby firmly securing the unit 14 to the work piece and creating an external magnetic flux path.

The passive pole pieces 16, 18 are important in assisting this magnetic coupling functionality, and are made from a ferromagnetic material with low magnetic reluctance, eg purified iron, soft iron or mild steel. The cross-sectional area of the unit housing wall, which is provided by the pole pieces, is, in the illustrated embodiment, non-uniform, in order to achieve an Increase in external magnetic field strength of the pole-piece-'loaded' permanent magnets; the external contour of the pole pieces, ie the wall thickness of the pole pieces 16, 18, is such as to reflect or be a function of the variation of the magnetic field strength around the perimeter of the permanently magnetised cylinders 20*a*, 20*b*.

Essentially, the design of the pole pieces follows the variation of the field strength H around the perimeter of the permanent magnet cylinders 20*a*, 20*b*, application of the inverse square law of magnetic fields in devising the external shape achieving good results, but use of specific materials for the pole pieces and magnets, and Intended application of the overall coupling device 10, require variation of and influence the optimal shape of the pole pieces 16, 18. For further details, refer to the aforementioned US patents.

The external shape of the pole pieces 16, 18 assembled about the cylindrical magnets 20*a*, 20*b* aims to maximise the external field strength and assist in holding the unit 14 in place on a work piece in cases of an incomplete 'external' magnetic circuit. It is preferred that the pole pieces 16, 18 are of the shortest possible length along axis A. The poles form part of the magnetic circuit (along with the magnets) of each unit 14. The poles have an inherent magnetic resistance ("reluctance") which results in loss of magnetic energy, even where high permeability materials are employed. In minimising the length of the poles, and overall height (or length) of the coupling units 14, loss of magnetic energy is minimised and hence external field strength maximised. The joint areas 36 that provide the interface between the facing pole pieces is provided with a very high reluctance, but thin layer, thereby maintaining magnetic separation of the pole pieces 16, 18, le preventing short circuiting.

Finally, the surface area of the axial end faces, see reference numerals 35 and 34, are preferably chosen to provide flux compression functionality. That is, the total cross-sectional (or foot-print) area of pole pieces 16, 18 will be chosen to be smaller than the cross section area of the magnets 20*a*, 20*b*, derived from the diameter of the cylinders times the total height. This allows to increase the flux density output of the unit 14 as compared to the maximum flux density which the active material can deliver. For example, since good ferromagnetic materials can reach saturation levels of 2 Tesla and above, it is possible to increase flux density in the poles to this level by reducing the total pole foot print area. Flux compression is not a fixed but a design parameter which is derived from magnetic flux density of the active source material multiplied by its cross section towards the pole pieces, flux saturation levels of the passive ferromagnetic (pole) material, and loss factors due to non-linearity of the B-H Curve of the pole piece material.

Figure 4:
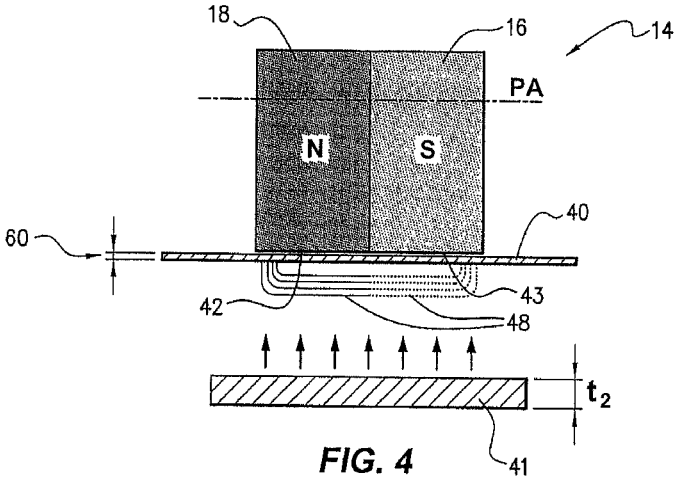
FIG. 4 is a schematic and highly simplified (side) view of a single, switchable permanent magnet unit illustrating some principles underlying an aspect of the present invention.
Figure 5:
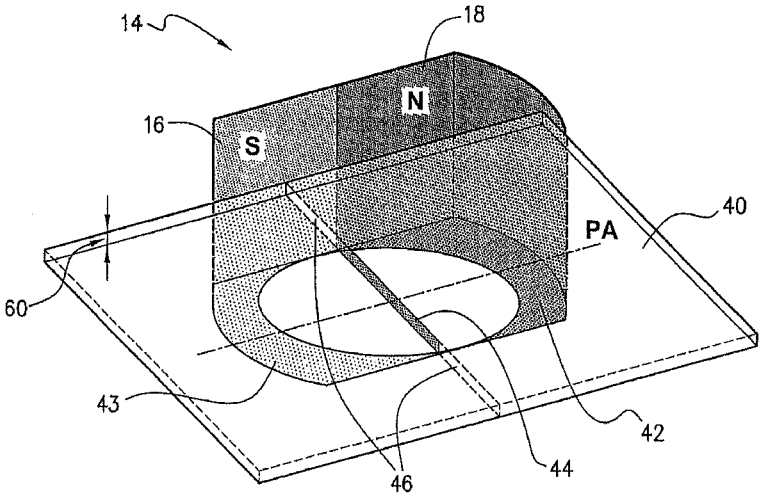
FIG. 5 shows a perspective schematic view of the single switchable permanent magnet unit of FIG. 3, illustrating flux exchange areas when the unit is in an activated state and in contact with a ferromagnetic sheet material work piece.

Turning next to FIGS. 4 and 5, there is illustrated an individual magnetic switching unit 14 in highly schematized fashion, placed in contact on a thin, sheet-like work piece 40, wherein the unit 14 is schematically illustrated in an activated state in which the north and south poles 21 and 22 (FIG. 3*a*) of the upper and lower magnets 20*a* and 20 *b* (FIG. 3*b*) coincide, and an external magnetic field is present; the lighter gray shaded portion of the unit 14 serves to denote the active south pole S that the magnets impose on one of the pole piece 16, and the darker gray shaded portion denotes the north pole polarity N switched onto the other pole piece 18.

The pole piece footprint areas on the work piece 40 are identified at 42 and 43 in FIG. 5, ie in this illustration, the lower axial end surfaces of the pole pieces identified at 34 in FIG. 3*b*, 'serve to provide the work piece engagement area of the unit 14. The magnetic flux 'exiting' the north pole piece 18 at its contact surface 42 will 'flow' through a magnetic flux path across the thickness t of the work piece 60 and 'enter' the contact area 43 of the other, south pole piece 16, which is otherwise closed into a magnetic flux loop extending through the vertical interface area between the north and south pole regions of the diametrically polarized cylindrical magnets (20) pole-aligned within the unit 14.

A primary effective flux exchange area 44 within the work piece 40 is that section of the total flux exchange area where flux density saturation is present. Since the magnetic field of the unit 14 is not confined to its footprint area, the total flux exchange area is extended by secondary effective flux exchange areas 46, located traversely to both sides of the central area 44 where the flux density declines with distance from unit 14. These secondary effective flux exchange areas 46 are maintained by flux leakage, which results from the (flux) saturation of the work piece, and the sizes of the flux exchange areas 44, 46 depend on the degree by which the work piece can absorb the flux. High flux absorption results in lower flux leakage and the secondary effective flux exchange areas shrink.

If the thickness t of the work piece and the related total effective flux exchange area (62 and 64) in the work piece is smaller than the footprint area 42 or 43 of an individual pole piece 16 or 18, and/or the flux saturation (properties) of the work piece material are such that saturation occurs at a lower flux density than that of the pole pieces, the flux exchange is restricted and the flux density at the pole contact area drops. The result is a sharp decline of 'pulling force' exerted by the unit 14 onto the attached work piece 40, in accordance with the interrelationship between flux density and pulling force: magnetic pulling forces vary with the square of flux density but only linearly with pole area.

As noted, if the work piece 40 cannot carry the whole flux of a unit 14, flux saturation occurs in the work piece 40 and the magnetic field generated by the superimposed individual magnetic fields of the two magnets 20 within the unit 14 extends beyond (in the thickness direction) the work piece 40, as is schematically illustrated at 48 in FIG. 4. Therefore, in attaching to a single sheet material work piece 40, the available magnetic energy which the unit 14 is able to provide in its fully activated state, is only partially utilized. It will be noted that the schematically illustrated magnetic field 48 extends through the thickness of the sheet material and is able to interact with other ferromagnetic work pieces 41 located beneath sheet material 40. Depending on the thickness of additional work piece sheet material 41, which may be a stack of sheets with total thickness t2, and the distance thereof from the saturated work piece sheet 40, the unit 14 will be able to magnetically lift additional sheets 41 up to a combined thickness where the combined flux exchange area of the stacked sheets 40, 41 is about equal to that of the pole piece contact areas 42 or 43 as described above.

The extent by which the magnetic field will go beyond the immediately adjoining work piece 40 will of course depend on the active magnetic material mass present in an Individual magnetic coupling unit 14.

Figure 7A:
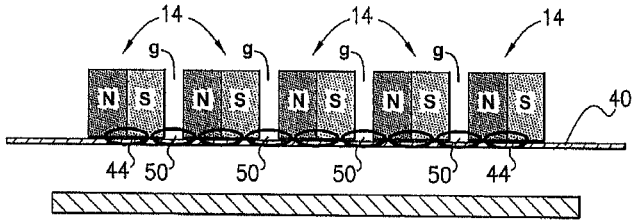
Figure 7B:
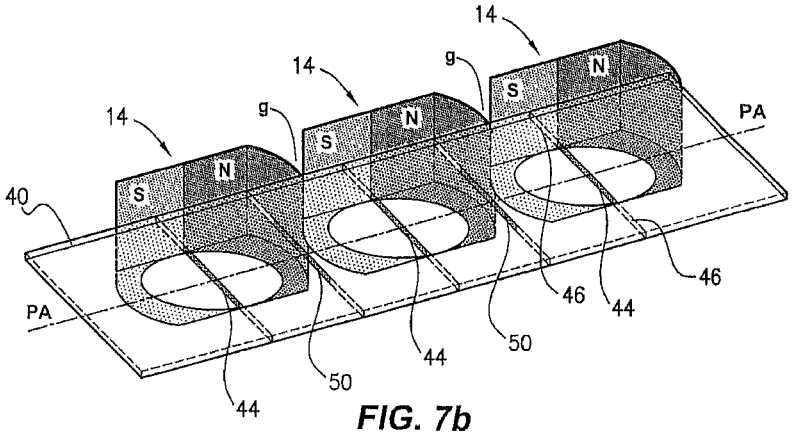
FIG. 7*b* represents a perspective schematic view of a three magnet linear array.

In accordance with one aspect of the present invention, instead of using a single or a number of relatively distantly spaced apart units 14, which are rated to provide a specified lifting or coupling force, the necessary active magnetic mass required to provide the necessary coupling force (apart from any force and/or flux transfer magnifying influences which pole piece shaping may contribute, see above), is subdivided into a number of smaller switchable magnet units 14, compare for example the schematic illustrations in FIGS. 7*a* and 7*b*. As per FIGS. 1 and 2, the units 14 will be secured and arranged in a larger housing (not shown) of a non-ferromagnetic material. Importantly, the units 14 will be deployed in specific types of array configurations as will be discussed below, compare also the illustrations of FIGS. 8*a* to 8*c* and 10, which allow interaction of the individual units 14 to achieve an improved performance.

It will be appropriate to define a further geometric parameter that is necessary to describe not only the overall arrangement of individual units 14 in any given array, but also the relative location of the north and south poles of activated individual units 14. Referring to this end to FIG. 5, there is illustrated a so called polarization (or polar) axis PA of an individual unit 14, which axis is characterized by extending perpendicular to the (vertical) interface plane defined when the individual interface planes 24 (see FIGS. 3*a* and 3*b*) of the individual diametrically polarized cylindrical magnets 20*a* and 20*b* of the unit 14 are coterminous in that common plane, i.e. when the unit 14 is either in the fully activated or fully deactivated state where the magnetization axes MA of the individual magnets 20*a* and 20*b* are parallel aligned. In FIG. 5, the coupling unit is illustrated in its fully activated state. In essence, therefore, the polarization axis PA defines a north to south pole orientation axis in the fully activated state of the unit 14, and may be visualized as being the N-S magnetization axis of a simple dipole bar magnet, compare e.g. FIG. 6, and such simplified (activated) magnet analogy will be used in the further description.

Figure 6:
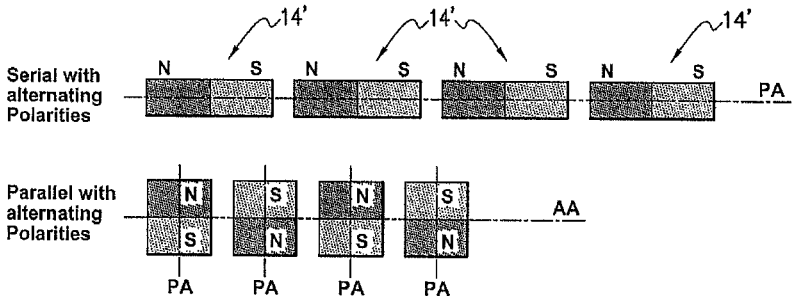
FIG. 6 is a schematic illustration of two linear magnet array configurations in accordance with one aspect of the present invention.

Turning then to FIGS. 7*a* and 7*b*, there are schematically illustrated a number of individual coupling units 14 disposed in a linear array wherein the units 14 are held spaced apart from one another by equal gaps (g), the polar axes PA of the individual units 14 being arranged in series and coaxially with one another such that north and south poles of the activated units 14 are arranged in alternating sequence. FIG. 6 illustrates in highly schematised manner the serial alternating array configuration embodied in FIGS. 7*a* and 7*b* (represented by simple N-S bar magnets 14'), as well as another serial array configuration in which the polarization axes PA of the units 14' extend perpendicular to the axis AA of the array. It will be noted there that adjoining (or neighboring) magnets 14 also face one another across the gaps with alternating N-S polarities.

Referring back to FIGS. 7*a* and 7*b*, it will be seen that, within the work piece 40, apart from the individual effective flux exchange areas (44 and 46 in FIG. 5) present at each coupling unit 14, there are additional effective flux exchange areas (here termed tertiary flux exchange areas 50) between each pair of units 14 that are formed as consequence of the relative close spatial distance of the individual units 14 in the array line and which exist due to the interaction of the magnetic fields of respectively neighbouring unit pairs. In the illustration of FIG. 7*a*, the alternating polar arrangement of five units 14 add four effective tertiary flux exchange areas 50, which also assist in confinement of the magnetic field of each individual unit 14. One effect which the tertiary flux exchange areas 50 have is an increase of flux density at the pole contact areas 42, 43 of each unit 14 if that flux density is restricted by high reluctance of the work piece 60 on which the array of units 14 act. Higher pulling forces and improved magnetic efficiency are achieved in this way, as compared to the use of a single unit 14 having the same overall active magnetic mass as the sum of the individual units 14.

The spacing (or linear gap g) between the individual units 14 gives control over the total field magnitude. Short distances g between adjacent units 14 will emphasise the flux exchange between the separate units 14, with a decrease in total field intensity and overall penetration depth. Wider spacing g between units 14 will give more weight to the flux exchange between the magnetic poles of Individual units 14, with an overall increase of field strength and deeper flux penetration into work pieces.

Figure 8A:
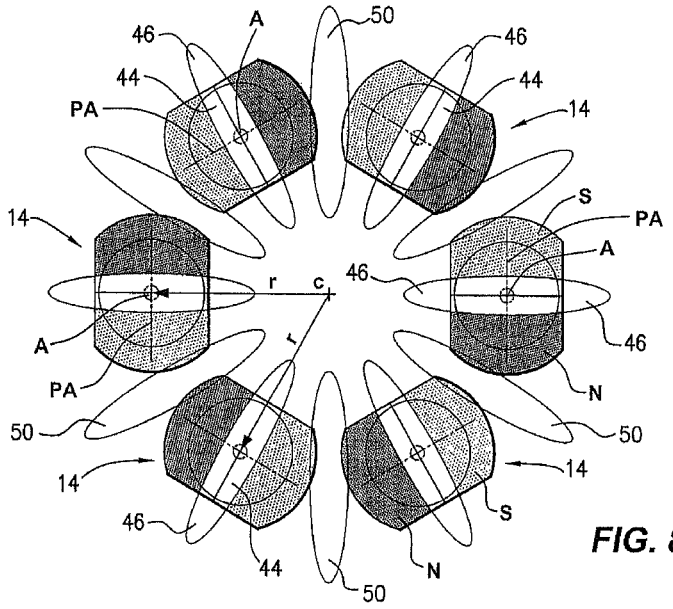
FIGS. 8*a* to 8*c* are schematic plan bottom views of 3 different circular array magnetic device configurations as contemplated in the present invention, the array of FIG. 8*a* being embodied physically in the lifter device of FIG. 2.
Figure 8B:
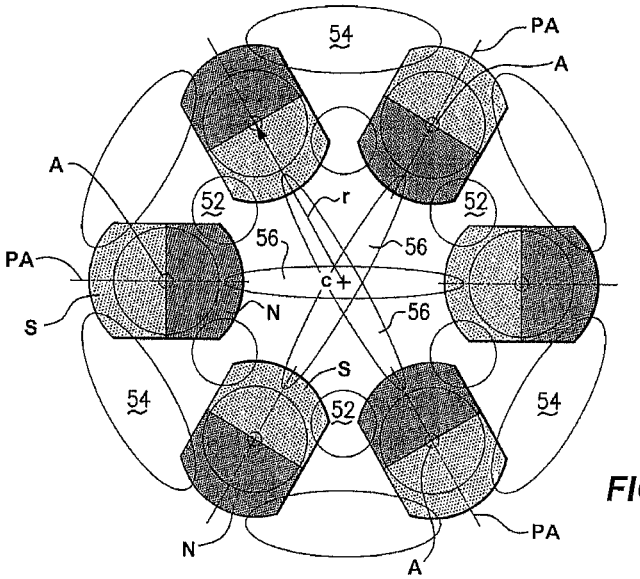
Figure 8C:
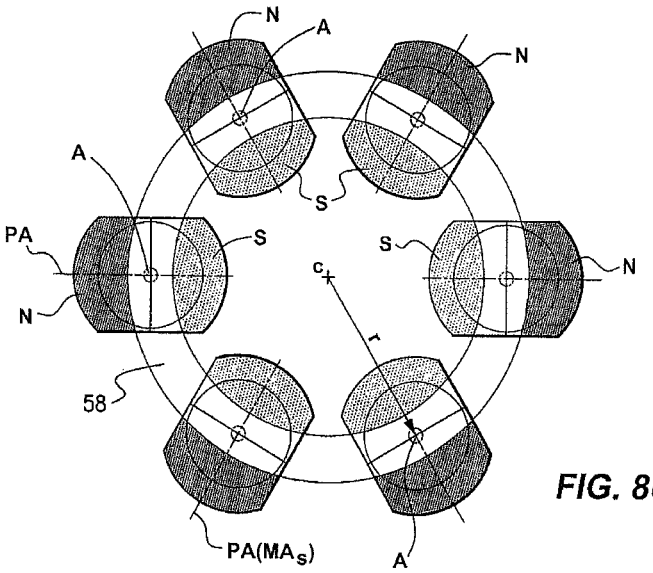

FIGS. 8*a* to 8*c* show a schematic plan (bottom or top) view of a circular array arrangement of Individual units 14, as compared to the linear arrays of FIG. 6. The circular array configuration of FIG. 8*a* is embodied in the test rig illustrated in FIG. 1 and in the magnetic lifter device 100 shown in FIG. 2. In the lifter device 100 of FIG. 2, six individual units 14 are secured in fixed but removable manner in an outer cylindrical housing part 120 that has a circular face plate 135 against which a work piece (not shown) may be abutted. An actuator module 130 which houses a not illustrated mechanical arm linkage arrangement is bolted to the rear of housing part 120 and provides a means by way of which the equally not illustrated actuating devices (eg as illustrated at 30 in FIG. 3*b*) of the individual units 14 can be operated to jointly activate and deactivate the individual units 14 as was described above.

It will be noted that the circular array configurations of FIGS. 8*a* and 8*b* essentially represent the closing of the free ends of the linear serial arrays with alternating polarities illustrated in FIG. 6, and thereby provide self-contained array configurations where all units 14 have a neighboring unit 14, which allow interaction between unit pairs. For that reason also, circular array configurations are preferred as there is a more homogeneous force field distribution as compared to an open-ended linear, rectangular or other column-row array.

In the array illustrated in FIG. 8*a*, six units 14 are placed with the respective magnet stacking axis A of each unit 14 extending perpendicular to an imaginary circle of radius r and the drawing plane, with the polar axis PA of each unit 14 extending substantially tangentially at said imaginary circle line that joins the stacking axes A (Le. essentially perpendicular to said radius r) and with the activated north poles of a respective unit 14 facing the activated south pole of a neighboring unit 14 and vice versa. In this array configuration, there are twelve effective flux exchange areas, consisting of six primary and secondary flux exchange areas 44/46 at the individual units 14 and six tertiary flux exchange areas 50 between neighboring units 14.

In the array of FIG. 8*a*, there are also magnetic field interactions between the north and south poles of non adjacent units 14, however these are in practice marginal and so weak that they do not contribute to the effective overall flux exchange areas 44/46 and 50.

As can be noted in comparing FIGS. 8*a*, 8*b* and 8*c*, circular array configurations of individual units 14 can create different effective flux exchange areas, depending on the relative orientation of the polar axis PA of each unit 14 in the global array and relative to neighbouring units 14. A so called alternating star array configuration is illustrated in FIG. 8*b*, wherein the same array radius r is present as in the circular array of FIG. 8*a*. However, in this array configuration, the individual units 14 are disposed with their polar axis PA in a radial arrangement (hub and spoke), substantially coaxial with the respective radii to each unit, with the units 14 having either the active north or south pole facing inwards and the other pole facing outwardly. At the same time, neighbouring units 14 are arranged with alternating poles facing radially inwards and radially outwards whereby active north and south poles of neighbouring units are adjacent.

FIG. 8*b* illustrates schematically also the effective flux exchange areas that are present in this array configuration, wherein radially inward located tertiary exchange zones 52 are effective flux exchange areas between neighbouring units 14 exhibiting a relative strong exchange as compared to the radially outwardly located tertiary exchange zones 54, due to the increased distance of the radially outward located active poles of neighbouring units as compared to the inward located poles. Equally, due to the relative proximity of opposite polarity active poles of units 14 arranged on diametrically opposite sides of the overall array, there are three effective tertiary flux exchange zones 56 extending between radially facing units 14, the flux exchange zones 56 arranged in an intersecting, star like pattern.

If an increase of flux penetration depth is required, the array of FIG. 8*b* may be varied in to the array configuration shown in FIG. 8*c*, wherein whilst the same arrangement of units 14 is present, the activated poles (polarities) of the individual units 14 are disposed such that all units 14 have the same polarity at an inner radial end of the array, ie the units 14 are again arranged radially with the same pole of each unit 10 facing radially inwards with the other pole facing radially outwardly. In this array formation, the north and south poles of the individual activated units 14 are 'paralleled' along the circle defined by radius r and merge effectively into two annular, larger pole units, thereby defining a ring band shaped concentric effective flux exchange zone 58 formed from the individual unit effective flux exchange zone 44, 46. The magnetic field intensities are, however, not homogenous distributed along the exchange band, but reach maxima at the respective poles of the individual units 14. In effect, such array configuration does not have any tertiary flux exchange areas between neighboring units 14, and provides a flux exchange pattern that is comparable (in principle) with that of a common magnet cup design with a radially inner and an radially outer annular magnet pole.

Figure 9A:
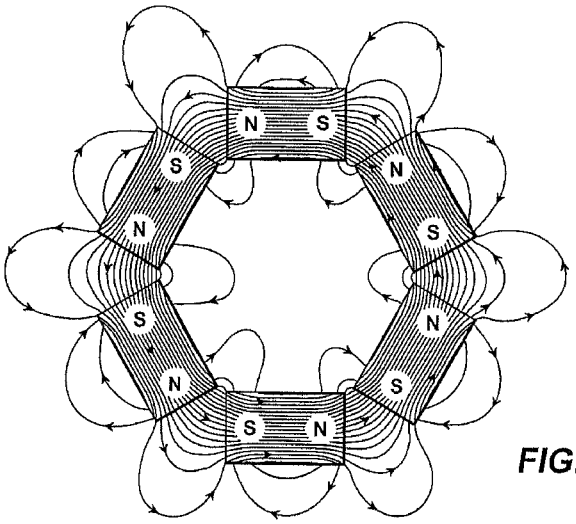
FIGS. 9*a* to 9*c* represent schematic 2-D (or plan view) illustrations of the magnetic field lines that would be detectable in the circular array configurations illustrated in FIG. 8*a* to *c*, respectively.
Figure 9B:
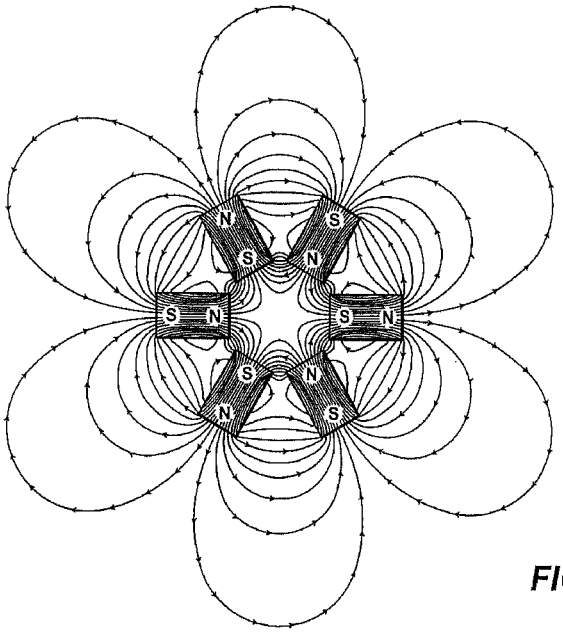
Figure 9C:
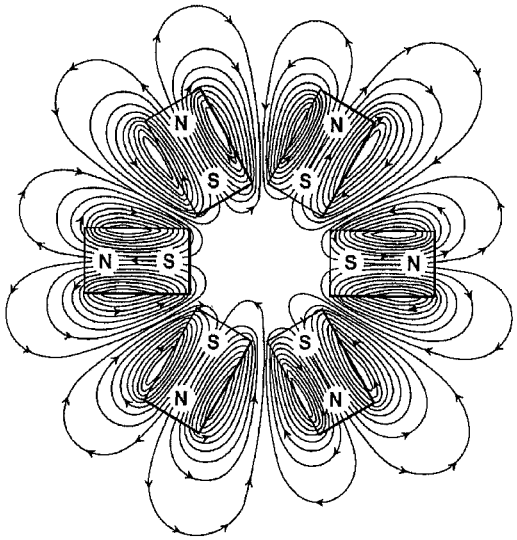

FIGS. 9*a* to 9*c* represent idealised 2-D magnetic field line patterns as would be present at the interface of the arrays of FIGS. 8*a* to 8*c*, respectively, when in contact with a very thin ferromagnetic sheet metal or Magpaper, generated using computer assisted modelling. It should be noted that the patterns are visualisation aids only, and represent an idealised model.

The field pattern illustrated in FIG. 9*a* is a shallow penetrating, relative confined H-field, wherein the arrangement of magnets with opposing polarities in such circular arrangement provides an effective self-regulating H-field, as is explained in greater detail below. In contrast, the field pattern illustrated in FIG. 9*b*, whilst also shallow penetrating, provides a relatively wider spreading H-field. Finally, the field pattern of 9*c* clearly illustrates a lack of magnetic interaction between neighboring magnets beyond the resultant compression of field lines of adjacent magnets in the array, whereby the magnetic energy is enlarged and achieving a H-field with deeper penetration perpendicular to the plane of drawing.

As will be apparent from the above description, the number and choice of the sizes of individual magnet units 14, and the spacing layout, can be determined depend on the intended area of use of a magnetic device incorporating the magnet array, eg coupling devices, lifters, etc, but in particular the properties of the ferromagnetic body in contact with which the array is to be brought. For example, the magnetic lifter test-jig illustrated in FIG. 1, employing an array of 5 switchable magnets Version M1008 by Magswitch, with a spacing of 1 mm between them, can exert a pulling force of 145N on a 0.8 mm iron sheet. The pull on a second sheet in direct contact underneath is hardly noticeable in this case.

The following table illustrates some of the basic advantages of subdividing a given mass of magnetically active material into discrete sub-masses and placing the so subdivided masses into a specific array configuration, as per the invention. The table summarises results of a lifting experiment conducted with 6 types of magnetic lifters, the first three in the table being magnetic lifters incorporating an array of six switchable magnets of the type Magswitch M1008 (ie as illustrated in FIGS. 2 and 3, the cylindrical magnets having a dimension of 10 mm diameter and 8 mm height), whereas the subsequent three members in the table employ one larger, switchable magnet of the type M2020, M3020 and M5020 (le 20 mm diameter×20 mm height magnets, 30 mm×20 mm and 50 mm×20 mm, respectively). In the table below, 'Alt. Star Array' designates an array configuration as per FIG. 8*b*, 'Joint Star Array' designates an array configuration as per FIG. 8*c* and 'Circular Array' designates an array configuration as per FIG. 8*a*.

| | Active magnetic material Volume $mm^3$ | Peak Pull in N | Pull on 1 mm sheet fully activated in N | Pull on 1 mm partial activated to match saturation levels in N |
|---|---|---|---|---|
| 1008 × 6 All. Star Array | 3768 | 420 | 260 | Self regulating |
| 1008 × 6 Joint Star Array | 3768 | 450 | 200 | 130 |
| 1008 × 6 Circular Array | 3768 | 220 | 200 | Self regulating |
| 2020 | 6263 | 450 | 180 | 80 |
| 3020 | 14137 | 750 | 270 | 110 |
| 5020 | 39270 | 1500 | 320 | 100 |

A number of observations are worthwhile. It will be noted that the maximum lifting capacity (peak pull in N) of a single M5020 magnet is only about 3.57 times that of the Alt. Star Array configuration, despite having a total active magnetic material mass of more than 10 times that of the array. The same array, when in engagement with a ferromagnetic sheet having a thickness of 1 mm will have a pull in N which is only 60 N lower than that of the single 5020 magnet, and 60 N higher than a single 2020 magnet which has about double the active material mass contained in the Alt. Star Array lifter. It will also be noted that when a single magnet unit 3020 is switched into a magnetisation state to match the magnetic saturation level capable of being carried by the 1 mm thick metal sheet, so as to practically confine the flux path into the sheet metal work piece and avoid the magnetic field to extend beyond it) that the pulling force is about 1/7 of the peak pull force and less than ½ the value as compared to its fully activated state (in which the magnetic field would extend beyond the thickness of the sheet metal). That is, with single magnets, lowering the magnetising force to avoid H-field extension beyond the work piece boundary, if magnetic flux is 'bottlenecked, results in a drop of pole flux density, and consequentially a reduction in available pulling force The array configuration provides for enlargement of the 'bottlenecked' flux area, due to the presence of the additional flux paths between neighboring array members, thus leading to an increase in overall pole flux density which results in higher pulling forces.

Of particular interest is, however, that both the Alt. Star Array and the Circular Array configurations exhibit what might be termed a self-regulating H-Field, allowing the pulling force to remain higher than in any of the other lifters listed in the table.

Figure 10:
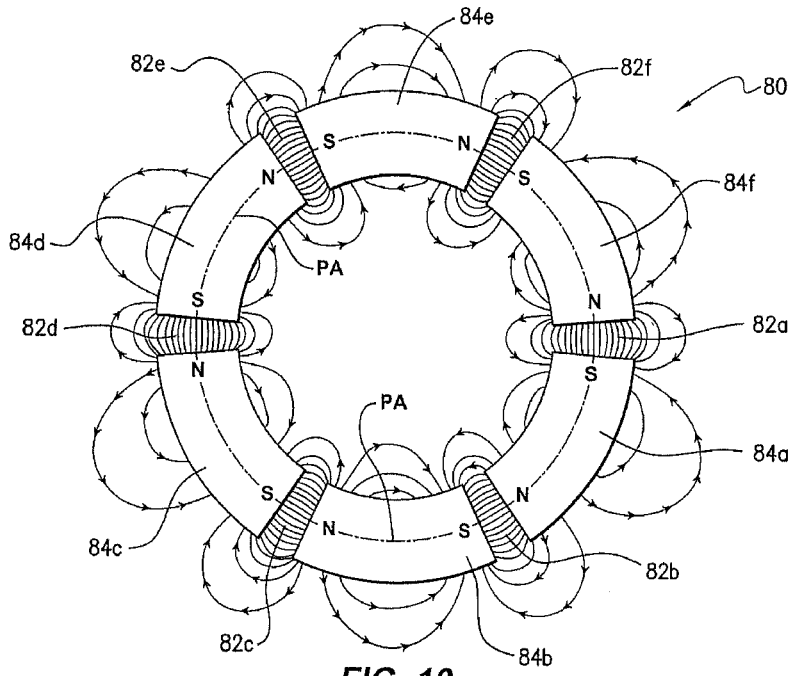
FIG. 10 is a schematic plan view of a magnetic field line model of a discontinuous magnet torus, intended to illustrate a further aspect of the present invention related to magnetic flux splitting and self-regulating field intensity.

This phenomenon will be explained with reference to FIGS. 10 and 11. In FIG. 10, an idealised 2-D model magnet torus 80 is illustrated, wherein an otherwise closed 6-pole magnet torus is opened at 6 discrete locations 82 *a* to *f*, thereby defining 6 dipole magnets 84*a* to 84*f* which in effect provide an arrangement similar to the circular dipole array configuration of FIG. 8*a* when activated (but for the slightly curved polarisation axes PA' of the dipoles 84*a* to *f*, given that they are not linear dipoles.

The idealized H-field pattern of a 'closed circuit' circular magnet array 80 with alternating polarities N-S in which neighboring magnets 84*a* to 84*f* are 'short-circuited' (either by bringing the peripherally facing magnet faces into abutment or by inserting a passive ferromagnetic pole piece into each gap so as to bridge each N-S pole pair of adjacent magnets) would be self-contained within the closed circuit and not available for use in nor accessible by an external working circuit. Opening of the torus at one or more locations (e.g. the six gaps 82*a* to *f* identified in FIG. 10) provides a number of portals, each of which allow 'access' to the magnetic energy stored in the active magnetic material of the (torus) array.

It will be noted in the opened torus 80 that at each gap 82 between neighboring magnets 84*a* to *f*, a flux exchange zone exists between opposite N- and S-poles of adjacent magnets 84*a* to *f*, thereby providing a flux path through the medium present in the gap volumes, and the overall array arrangement will provide a first (closed) magnetic circuit consisting of the magnets 84*a* to *f* and gaps 82*a* to *f*. When a ferromagnetic object is brought into magnetic interaction with one or more of the portals defined across 82*a* to *f*, magnetic flux available in the 'tank' circuit provided by the array is able to divert or 'split' at the portals and transferred into the object. A second (closed) circuit consisting of the ferromagnetic object, passive pole extension pieces (not shown) at the N- and S-poles of the adjacent magnets 84*a* to *f* against which the object is brought in contact and the two or more magnets 84*a* to *f* which the ferromagnetic object bridges can thus be formed, which has a magnetic reluctance that is lower than that of the first circuit, i.e. the array circuit.

The proportion of flux splitting into the second circuit will depend on the reluctance of both circuits. Put another way, if both the first and second magnetic circuit exposed to the same magnetomotive force have the same permeability, an equal flux sharing takes place. Increase of circuit reluctance in one of the circuits will result in a shift of flux from that circuit into the other and vice versa. This basic principle is embodied in the above described Circular and Alternating Star array configurations of FIGS. 8*a* and *b*.

Figure 11A:
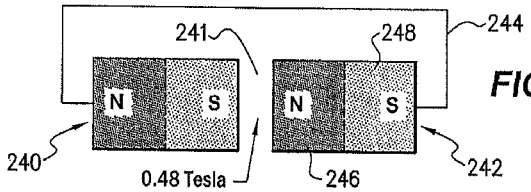
FIGS. 11*a* and *b* are schematic side views of two switchable permanent magnet units as per FIG. 3*b*, arranged into a linear array, but which can be incorporated into the magnet array configurations of FIG. 8*a* and FIG. 10.

The flux-splitting functionality aspect of the present invention may be best exemplified with reference to FIGS. 11*a* and *b*, which are schematic side views of two switchable permanent magnet units 240, 242 of the type illustrated in FIG. 3*b*, and which are arranged in a linear array as illustrated in FIGS. 5 and 6, in fixed positions next to one another with a small air gap 241 between the facing opposite N and S polarities (eg pole pieces 246, 248) of the units 240, 242. It will be appreciated that such idealised two-magnet arrays are also present in the circular arrays of FIGS. 8*a* and *b*, as well as the opened torus of FIG. 10.

In FIGS. 11*a* and *b*, line 244 simply serves to denote an idealised reluctance free bridge to achieve a closed (short) circuit between the S- and N-poles which do not face one another across the air gap 241 that is maintained between the other N- and S-poles of the units 240 and 242, so that only one portal exists in such arrangement.

Turning first to FIG. 11*a*, in the absence of a work piece (eg sheet metal piece 250 in FIG. 11*b*), a flux exchange path between the two magnets 240, 242 exists across the air gap 241 (the circuit being otherwise closed as indicated at 244). The magnitude of flux at a given magnetising force depends here mainly on the width and cross section of the air gap between the magnets 242, 240. Since the permeability of air is linear with flux density, the whole flux transfer behaviour in this part of the path is linear. Reluctance of the air gap magnetic circuit is thus dependent on the flux transfer area geometry and the permeability of the material in the gap, which might be a substance other than air but which should have ideally a very low relative permeability (that of air being about 1), but in any event considerably lower than the relative permeability of the work piece.

Figure 11B:
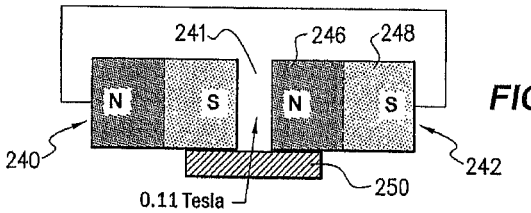

As seen in FIG. 11*b*, when a ferromagnetic work piece 250 with a higher permeability than that of air is brought into magnetic interaction with opposite poles of adjacent magnets 240, 242, an additional flux path between the opposite poles of magnets 240, 242 is created, which has a reluctance that is lower than that across the air gap 241. The amount of flux that will 'pass' through this path (or circuit) is governed mainly by the permeability of the work piece material (if the work piece has a small thickness). Flux is 'drawn' from the first (air gap) magnetic circuit and diverted into the second (work piece) magnetic circuit. The permeability of the work piece will be initially very high, ie several thousand times higher than air), until flux saturation is reached in the work piece. The permeability of the second circuit will gradually decrease (as the flux density increases), as per the relevant non-linear B-H magnetisation curve applicable for the work piece material, until saturation is reached. The reluctance in the second circuit will then be equal or higher than that of the air gap circuit, and no further magnetic energy will be 'withdrawn' from the air gap circuit.

As FIGS. 11*a* and *b* illustrate, a flux that may have an initially higher value across the air gap, eg 0.48 Tesla, in the unloaded 'tank' circuit, will be split when the work piece bridges opposite poles N and S of adjacent magnets 240, 242, and a lower flux will remain in the air gap 241, eg 0.11 Tesla, once saturation of the diversion circuit across the work piece is finalised Effectively, magnet array configurations which are devised with the above criteria in mind will provide a magnetic device exhibiting a self-regulated magnetic field strength when brought into magnetic interaction with a ferromagnetic work piece, the non-linear permeability of the work piece serving the purpose of regulating and stabilizing the available magnetizing force (magnetic field strength H) at the access portals within the first magnetic circuit. It should be added here that the overall level of magnetic energy that can be withdrawn from the array through the portals is inverse proportional to the distance between adjacent magnets.

Whilst the above described magnet array configurations utilise switchable permanent magnet units 14, 140, 240 as described also in the above mentioned patents, it will be understood that other dipole magnet units may be employed. The N-S magnetization axis may also not necessarily be straight linear, but could be in particular in the case of circular array formations slightly curved.

The specific geometry of the pole pieces that interact with the active magnetic material in the (switchable) magnet units may also be adapted and varied as required to achieve a desired flux transfer pattern from the active magnetic material into a work piece.

Equally, the material and shape of the housing in which the array of magnets will be held is to be chosen to suit the specific application, as is the precise layout of the array configuration, within the confines noted above.

It will equally be appreciated that FIGS. 9*a* to *c*, 10 and 11 illustrate idealised and simplified 2-D models of flux paths, magnetic field geometries and similar, which are based on 3-D artefacts, and which are influenced by numerous other effects and boundary conditions that open and closed (or loaded) magnetic circuits are subject to, eg imperfect magnetic paths, magnetic field leakage, etc. Also, computer modelling introduces some simplifications and inaccuracies in creating the drawings, so that these are to be seen as illustrative only of general principles.

Although the present invention has been principally described with reference to concepts that may find particular application in magnetic lifter and coupling devices, it will be appreciated that magnet arrays can readily be applied to other devices where a magnetisable (ferromagnetic) work piece is to be secured at such device either for holding same, or moving same securely attached to the device, and vice versa.

The invention claimed is:

1. Method of transferring magnetic flux from a source of magnetic flux into a ferromagnetic work piece, comprising the steps of:

providing as the source of magnetic flux (a) a plurality of magnets, each having at least one N-S pole pair defining a magnetization axis and passive pole extension pieces arranged for extending the magnetic poles of each said N-S pole pair, (b) disposed in a medium having a low relative magnetic permeability, (c) in an array configuration in which (i) gaps of predetermined distance are maintained between neighboring magnets in the array and in which (ii) the magnetization axes of the magnets are oriented such that immediately neighboring magnets in the array interact magnetically with one another across said gaps via opposite facing poles of the respective N-S pole pairs, such arrangement providing an array-internal magnetic circuit in which (iii) array-internal flux paths extend through the medium between opposite poles of the N-S pole pairs of neighboring magnets and (iv) magnetic flux access portals are defined by oppositely magnetized ones of the passive pole extension pieces of the magnets and neighboring magnets; and transferring magnetic flux from the array-internal magnetic circuit into a ferromagnetic work piece, the ferromagnetic work piece has a relative magnetic permeability substantially higher than the low relative permeability of the medium, by bringing at least the magnetic flux access portals defined between oppositely magnetized passive pole extension pieces of neighboring magnets into magnetic contact with a surface of the ferromagnetic work piece whereby a magnetic working circuit through the work piece is created which has an initial reluctance that is lower than that of the array-internal magnetic circuit and a limit of effective flux transfer from the array-internal magnetic circuit into the magnetic working circuit will be reached when the work piece approaches magnetic saturation and the reluctance of the working circuit through the work piece substantially equals the reluctance of the array-internal circuit through the medium, wherein the magnets are dipole permanent magnets having one N-S magnetization axis, wherein the permanent magnets are arranged in one or more concentric, closed circle or oval array(s), and wherein the magnetization axis of each of the permanent magnets extends coaxially with a radius extending from a center of the circle or oval to the respective permanent magnet.

2. The method of claim 1, wherein the magnetization axes of the dipole permanent magnets are arranged to extend within a common plane.

3. The method of claim 1, wherein the magnets are on/off-switchable dipole permanent magnets, and wherein the magnets are individually or jointly switched between an 'on' state in which magnetic flux is transferred via the magnetic flux access portals into the work piece, and an 'off' state in which magnetic flux is shunted within the permanent magnets and the respectively associated passive pole extension pieces.

4. The method of claim 3, wherein the on/off switchable dipole permanent magnets comprise a first permanent magnet dipole which is held stationary between the associated two passive pole extension pieces such that the passive pole extension pieces are respectively magnetized with opposite polarities, and a second permanent magnet dipole which is held movable relative to the first permanent magnet dipole and the passive pole extension pieces whereby the N-S pole pair of the second permanent magnet dipole can be brought selectively into magnetic alignment with the N-S pole pair of the first permanent magnet dipole to provide the 'on' state and into magnetic counter-alignment to provide the 'off' state in which a closed magnetic flux circuit is defined between the first and second permanent magnet dipoles and the two passive pole extension pieces.

* * * * *